US005114189A

United States Patent [19]

Nurmi et al.

[11] Patent Number: 5,114,189

[45] Date of Patent: May 19, 1992

[54] SUCTION BOX

[75] Inventors: Pekka Nurmi, Espoo; Heikki Salo, Turku, both of Finland

[73] Assignee: AKP-Tekno Oy, Espoo, Finland

[21] Appl. No.: 575,292

[22] Filed: Aug. 30, 1990

[30] Foreign Application Priority Data

Aug. 31, 1989 [FI] Finland ..... 894102

[51] Int. Cl.[5] ..... F16L 21/00

[52] U.S. Cl. ..... 285/7; 285/12; 285/64; 285/119; 285/205; 285/901

[58] Field of Search ..... 285/7, 64, 12, 119, 285/205, 901; 15/314

[56] References Cited

U.S. PATENT DOCUMENTS

| | | | |
|---|---|---|---|
| 3,088,484 | 5/1963 | Marsh | 285/7 X |
| 3,676,986 | 7/1972 | Reiling | 285/7 X |
| 3,682,500 | 6/1972 | Hamrick | 285/7 |
| 4,307,901 | 12/1981 | Orberg | 285/64 X |

*Primary Examiner*—Dave W. Arola
*Attorney, Agent, or Firm*—Kane, Dalsimer, Sullivan, Kurucz, Levy, Eisele and Richard

[57] ABSTRACT

The invention relates to a suction box for a central vacuum system, comprising a cover part (1) designed to be mounted against the exterior surface of a wall, a counterpart (2) of the cover part, designed to be mounted inside the wall, and a 90° suction bend (3) designed to bend the suction tube inside the wall to a direction parallel to the plane of the wall. According to the invention, the counterpart (2) and the auction bend (3) constitute a solid integral body (4) comprising a supporting surface (5) resting against the interior surface of the wall board, a round-shaped mounting flange (6) raised from the supporting surface and designed to be placed in a hole in the wall, and curved and elongated attachment areas (7) to which the cover part (1) can be fastened.

8 Claims, 2 Drawing Sheets

SUCTION BOX

Figure 1:
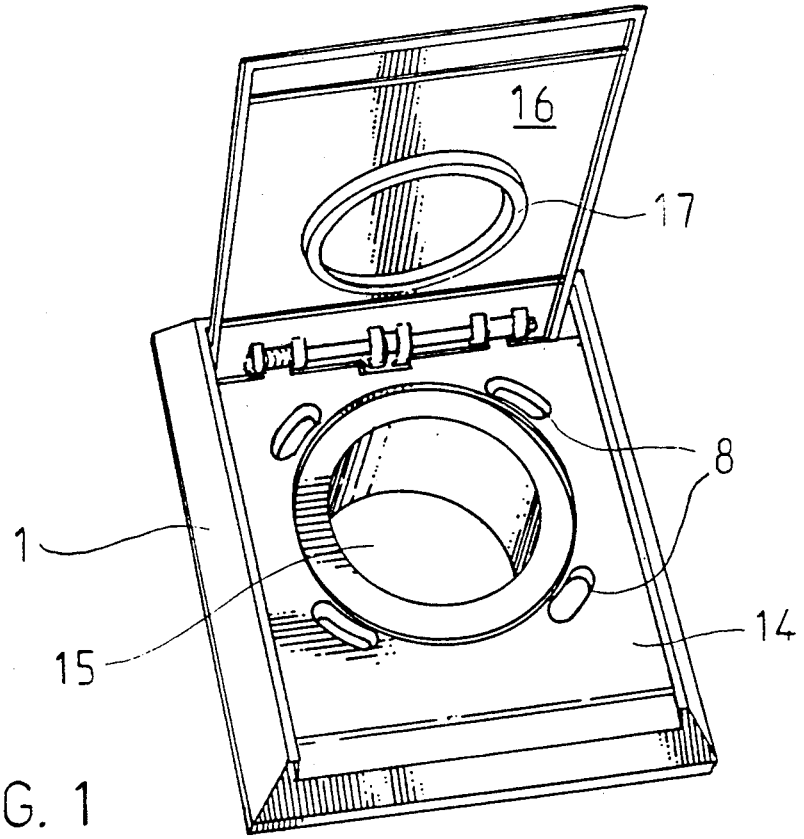

The present invention relates to a suction box designed for use in central vacuum systems.

In central vacuum systems, the central suction unit is generally placed in a compact space of secondary importance in the building. The suction pipes are mounted inside the wall and floor structures, connecting the central unit to suction boxes mounted at suitable locations in the walls of the rooms. For vacuuming, a suitable suction hose provided with a nozzle is connected to a suction box. The suction boxes currently used generally consist of three main parts: a cover part mounted on the exterior surface of a wall, a separate tube with a 90° bend, and a frame which is secured on the frame structures of the wall or on the wall boards. The cover part is attached to the frame, which is generally provided with fits arranged in four different directions allowing the 90° suction bend to be so mounted in one of them that a suction pipe running inside the wall and in the direction of the wall can be connected to the suction box and bent to a direction perpendicular to the plane of the wall surface. Previously known suction boxes also use separate mounting plates which are first mounted on the wall, different parts of the box being then attached to the mounting plate.

Previously known suction boxes have several drawbacks. They consist of several parts which have to be installed and fitted together. Their frames are large and angular bodies which are difficult to mount in place as they require angular holes in the wall boards, such holes being difficult to work. The cover part has provision for only a relatively narrow range of fitting adjustments, which means that the holes and fits in the walls must be made relatively accurately in the right positions. The 90° suction bend used can only be mounted in certain directions, so that the pipes inside the walls often have to be bent or turned. A further drawback is the use of several different materials in the structures of the various parts, resulting in a complicated and costly production process.

The object of the present invention is to eliminate the drawbacks mentioned above. A specific object of the invention is to produce a new type of suction box which has a simple structure and is therefore cheap to manufacture, and which permits quick and simple installation of the box as well as a large variety of adjustments.

As for the features characteristic of the invention, reference is made to the claims.

The suction box of the invention, designed for use in central vacuum systems, comprises a cover part designed to be mounted on the outer surface of a wall, a counterpart designed to be mounted inside the wall, and a 90° suction bend designed to bend a suction pipe belonging to the suction box from a direction perpendicular to the wall surface into a direction parallel to the plane of the wall. The cover part is preferably provided with a suitable openable cover known in itself, covering an opening provided with starting devices, so that when a suction hose is inserted in the opening, the central suction unit is started up.

In the suction box of the invention, the counterpart and the suction bend constitute a solid integral body, i.e. the counterpart and the suction bend are parts of the same solid structure, made of the same material, e.g. a plastic body made by injection-moulding, comprising a supporting surface designed to be mounted against the interior surface of a wall board, a round-shaped mounting flange raised from the supporting surface and designed to be placed in a hole in the wall, and curved and elongated attachment areas to which the cover part can be fastened.

The cover part is preferably provided with elongated and curved mounting holes placed around the opening and extending in a direction parallel to its circumference, said holes being located in areas corresponding to the attachment areas of the counterpart, so that the cover part can be fastened to the attachment areas using suitable securing means, e.g. screws, passed through the mounting holes.

In a preferred embodiment of the invention, the counterpart is provided with one or more intermediate posts or pins extending from the supporting surface of the counterpart towards the opposite wall board, the length of the post or pin corresponding to the distance between the wall boards. Thus the intermediate pins hold the counterpart steady between the wall boards while the mounting flange rests against the edges of the opening provided in one of the boards. With this arrangement, the counterpart need not necessarily be fixed to the wall boards.

In a preferred embodiment of the invention, the counterpart is provided with holders, e.g., straight holding plates, placed in the region of the suction band and essentially forming a solid part of the tube, said holding plates resting against the interior surface of the opposite wall board, providing additional support and rigidity to the counterpart.

In a preferred embodiment of the invention, the counterpart is provided with separate adjustment pieces of different thicknesses, which can be mounted e.g. on the intermediate pins and holders, allowing the total depth of the counterpart to be adjusted so as to make it fit tightly in wall structures of different thicknesses.

In a preferred embodiment of the invention, the attachment area of the counterpart consists of a number of adjacent holes, of which there may be two or more, or, in another embodiment, the attachment area may consist of a narrow elongated slot through which the securing screws can be screwed in relatively freely at a desired location.

In a preferred embodiment of the invention, the counterpart is also provided with at least one, preferably two ducts for electric conductors, said ducts being so laid in the body of the counterpart that they open in the same direction with the 90° suction bend both at the end perpendicular to the wall surface and at the end parallel to the plane of the wall. These ducts serve to accomodate the electric conductors which must be accesible through the cover part to allow control of the central suction unit of the system.

In a preferred embodiment of the invention, the counterpart also comprises mounting brackets, suitable lugs or equivalent, fitted at the level of the supporting surface and provided e.g. with holes permitting the counterpart to be attached with screws to the interior surface of a wall board or some other suitable place. However, in the suction box of the invention, the cover part and its counterpart are preferably only attached to each other, these parts being placed on opposite sides of an essentially round opening in the wall board, with suitable screws tightening the parts against each other, no other attachment being required.

As compared to previously known suction boxes, the invention has the following advantages:

simple construction, consequently low manufacturing costs, simple and easy installation in round holes in a wall, the same holes being also usable for the installation of electric wall sockets, easy adjustability allowing installation in structures of different thicknesses, and practically stepless adjustment of the orientation of the counterpart, permitting simpler installation of the pipes inside the wall.

Figure 2:
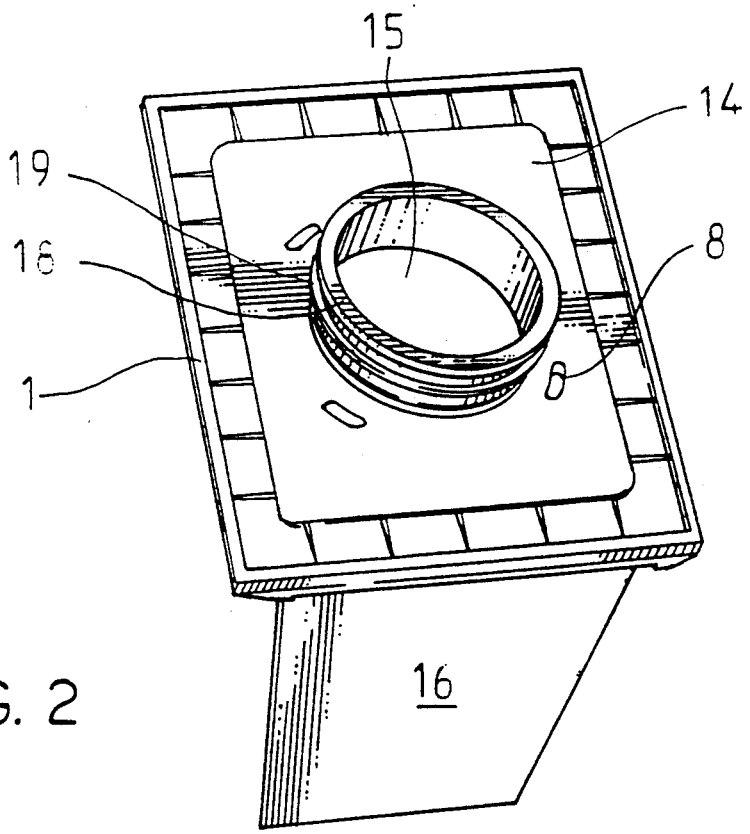
Figure 3:
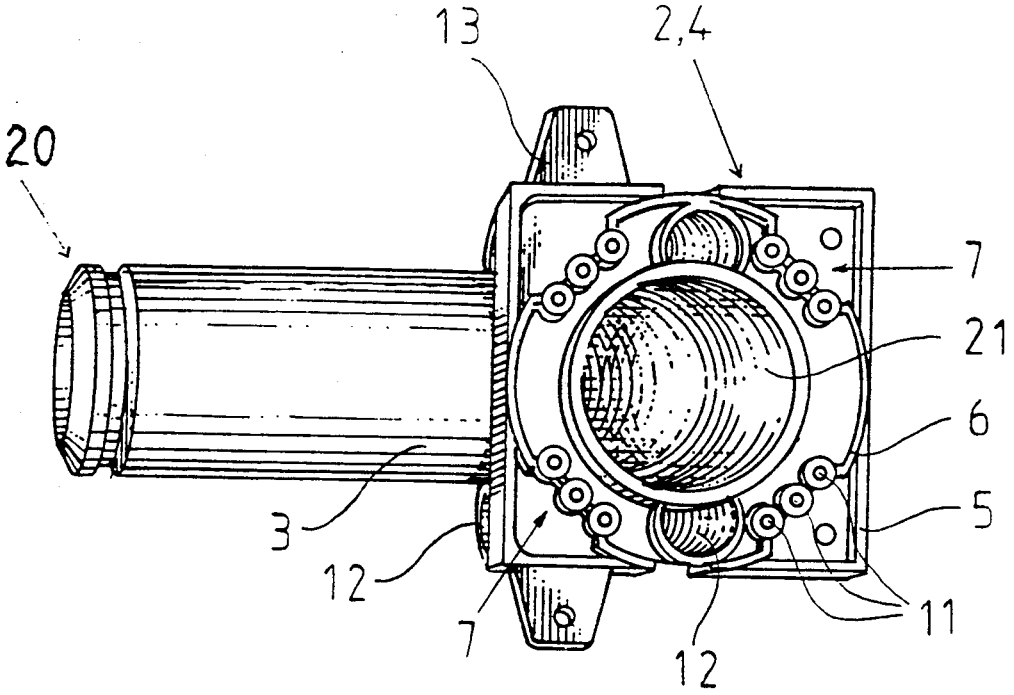
Figure 4:
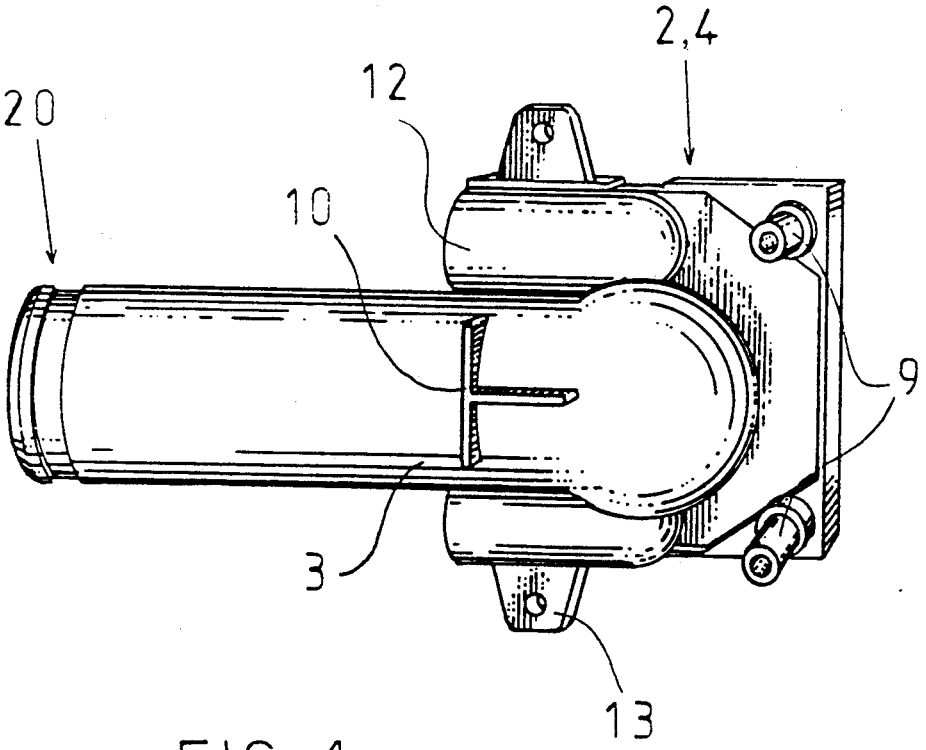

In the following, the invention is described in detail by referring to the appended drawings, in which FIG. 1 presents the cover part of a suction box as provided by the invention, FIG. 2 presents the cover part in FIG. 1 in rear view, FIG. 3 presents the counterpart connected to the cover part of FIG. 1, and FIG. 4 presents the counterpart in FIG. 3 as seen from the other side.

FIG. 5 shows the suction box of the present invention mounted in a wall between the two wall boards thereof, and communicating through a hole in one of the wall boards.

In an embodiment of the invention, the cover part 1 of the suction box is a body as illustrated by FIGS. 1 and 2, comprising a frame 14 designed to be mounted on the interior surface of a wall, the frame having in its middle a round opening 15 of a size corresponding to the suction hoses used, and a lid 16 hinged on the frame 14 and designed to cover the opening 15, the lid being provided with a gasket 17 to shut the opening 15 so as to prevent the influx of air into it when the lid 16 is closed.

As illustrated by FIG. 2, the rear side of the cover part is provided with a round flange 18 extending into the wall, with sealings 19 around it to ensure a tight fit between the cover part 1 and the counterpart 2. Moreover, the cover part 1 is provided with curved and elongated holes 8 placed around the opening 15. The function of these holes will be explained later on.

FIGS. 3 and 4 illustrate the counterpart 2 of the invention, which can be mounted on the inside of a wall board and attached to the cover part 1. The counterpart consists of a single solid integral body made of the same material, e.g. injection-moulded plastic. The counterpart comprises a suction bend 3, i.e. a tube bent into an angle of 90°, which opens into the opening 15 of the cover part in a direction perpendicular to the wall surface and has a bend inside the body so that it opens at the other end in a direction parallel to the wall surface. This other end is provided with suitable folds, fits or seals 20 permitting connection to the piping system inside the wall. In addition, the integral body 4 comprises a straight supporting surface 5 which is pressed against the interior surface of the wall board, and a round-shaped mounting flange 6 which can be fitted in the round hole in the wall so as to allow the supporting surface 5 to be pressed against the wall board.

The mounting flange 6 comprises attachment areas 7 placed at even distances around the opening 21 of the tube. In this embodiment, each of these areas consists of three adjacent holes 11. The cover part 1 can be attached to the counterpart 2 by driving suitable screws into these holes through the mounting holes 8 provided in the cover part. The screws can be tightened in any one of the three holes in the attachment area, depending on the position of the counterpart in the wall. Thus, and because the mounting holes 8 in the cover part 1 have an elongated shape, the cover part and the counterpart can almost always be so attached together that the cover part will be in the desired position on the wall regardless of the position of the counterpart inside the wall. Since the wall board is squeezed between the cover part 1 and the counterpart 2 when these are tightened together, they need not necessarily be fixed to the wall board, although the embodiment described is provided with mounting brackets 13 allowing the counterpart to be attached with screws to the interior surface of the wall board.

The integral body 4 of the invention depicted in the figure also comprises two intermediate pins 9, which are elongated peg-like parts extending from the supporting surface 5 in the opposite direction beyond the suction bend 3, these pins determining the total thickness of the integral body 4. Thus, with the length of the intermediate pins corresponding to the distance between the boards of the wall in which the suction box is mounted, the intermediate pins keep the counterpart steady between the wall boards while the mounting flange 6 is in the hole provided in one of the boards. Therefore, the counterpart cannot move or play to and fro in its position. It can only rotate when the end 20 of the tube is turned to the desired direction.

In addition, the counterpart 2 is provided with a holder 10 forming a third point of support at a distance from the intermediate pins 9, holding the counterpart 2 steady against the opposite wall board. The counterpart 2 also comprises two ducts 12 for electric conductors, placed on either side of the suction bend 3. These are smaller tubes opening at both ends in the same direction as the suction bend 3. Through these ducts, the electric conductors mounted in the wall and used for controlling the central suction unit can be passed to the cover part 1 of the suction box.

FIG. 5 shows the suction box of the present invention mounted in a wall 30 between a first wall board 31 and a second wall board 32, and communicating through a hole in the first wall board 31, as described above.

By choosing the dimensions of the suction box of the invention so that the diameter of the mounting flange 6 corresponds to that of the holes (74 mm) normally made for electric sockets in the wall, the installation of a central vacuum system will become a quick and simple operation as all the necessary holes in the walls can be made using the same tool. Similarly, the task of mounting the suction boxes becomes easier because the parts of the box need only be attached and tightened together, squeezing the wall board between them. Thus, the suction box can be easily mounted e.g. on gypsum board, which has a strong tendency to be broken when screws or equivalent fastening means are used.

Although the detailed description of the invention presented above refers to one of its preferred structural solutions, several embodiments of the invention are possible within the scope of the idea of the invention as defined in the following claims.

We claim:

1. Suction box for a central vacuum system to be placed inside a wall between a first and a second wall boards which comprise the wall, and to communicate through a hole in said first wall board, comprising:

a cover part having means defining a hole therethrough to communicate through said hole in said first wall and said cover plate designed to be mounted on the exterior surface of said first wall board over said hole therethrough;

a counterpart of said cover part, said counterpart designed to be mounted inside said wall between said first and second wall boards to communicate through said hole in said first wall board, said counterpart being a solid integral body with a 90° suction bend designed to bend a suction tube inside said wall from a direction perpendicular to said wall to a direction parallel to the plane of said wall, said counterpart further having a supporting surface to be placed against the interior surface of said first wall board around said hole therethrough;

characterized in that said solid integral body of said counterpart comprises:

a round-shaped mounting flange having a hole therethrough communicating with said suction bend and raised from said supporting surface and designed to be placed in said hole in said first wall board and said cover part having means thereon to sealingly communicate with said hole in said round-shaped mounting flange so that said hole in said cover part, said hole in said round-shaped mounting flange and said suction bend provide a continuous suction opening therethrough;

curved and elongated attachment areas on said mounting flange for fastening said cover part to said counterpart, so that said cover part may be mounted on said exterior surface of said first wall board, and said counterpart may be mounted inside said wall by said fastening of said cover part to said counterpart and means for fastening said cover part to said attachment areas; and intermediate posts extending from said supporting surface to the interior surface of said second wall board, said intermediate posts keeping said counterpart steady between said first and second wall boards when said mounting flange is in said hole in said first wall board.

2. Suction box according to claim 1, characterized in that said means for fastening include said cover part having elongated mounting holes at locations corresponding to said attachment areas of said counterpart.

3. Suction box according to claim 1 or 2, characterized in that said 90° suction bend has holders designed to keep said counterpart between said first and second wall boards steady against said second wall board, said holders keeping said counterpart steady in conjunction with said intermediate posts.

4. Suction box according to claim 3, characterized in that said suction box further comprises an adjustment piece, said adjustment piece fitting between said holders and said intermediate posts of said counterpart and said interior surface of said second wall board when said mounting flange is in said hole in said first wall board, so that said counterpart may be held steady between said first and second wall boards.

5. Suction box according to claim 1, characterized in that said attachment area comprises a plurality of adjacent holes.

6. Suction box according to claim 1, characterized in that said attachment area comprises a narrow elongated slot.

7. Suction box according to claim 1, characterized in that said counterpart further comprises at least one duct for accommodating electric conductors, said duct opening at both ends in the directions of said 90° suction bend.

8. Suction box according to claim 1, characterized in that said counterpart further comprises at least one one bracket placed at the level of the supporting surface, said bracket having at least one hole through which a fastening member may be directed, said bracket permitting said counterpart to be attached to said interior surface of said first wall board.

* * * * *